US008269093B2

(12) United States Patent
Naik et al.

(10) Patent No.: US 8,269,093 B2
(45) Date of Patent: Sep. 18, 2012

(54) METHOD FOR CREATING A BEAT-SYNCHRONIZED MEDIA MIX

(75) Inventors: Devang K. Naik, San Jose, CA (US); Kim E. Silverman, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 677 days.

(21) Appl. No.: 11/842,879

(22) Filed: Aug. 21, 2007

(65) Prior Publication Data

US 2009/0049979 A1 Feb. 26, 2009

(51) Int. Cl.
*G10H 7/00* (2006.01)

(52) U.S. Cl. ..... 84/612

(58) Field of Classification Search ..... 84/612, 84/636

See application file for complete search history.

(56) References Cited

U.S. PATENT DOCUMENTS

| | | | | |
|---|---|---|---|---|
| 4,692,915 | A | 9/1987 | Moriya et al. | |
| 6,344,607 | B2 * | 2/2002 | Cliff | 84/611 |
| 6,933,432 | B2 * | 8/2005 | Shteyn et al. | 84/609 |
| 7,081,582 | B2 * | 7/2006 | Basu | 84/625 |
| 7,220,911 | B2 * | 5/2007 | Basu | 84/625 |
| 7,525,037 | B2 * | 4/2009 | Hansson et al. | 84/615 |
| 7,592,534 | B2 * | 9/2009 | Yoshikawa et al. | 84/612 |
| 7,615,702 | B2 * | 11/2009 | Becker et al. | 84/612 |
| 2001/0039872 | A1 * | 11/2001 | Cliff | 84/609 |
| 2004/0252397 | A1 | 12/2004 | Hodge et al. | |
| 2005/0249080 | A1 | 11/2005 | Foote et al. | |
| 2006/0000344 | A1 * | 1/2006 | Basu | 84/612 |
| 2006/0107822 | A1 | 5/2006 | Bowen | |
| 2008/0121092 | A1 * | 5/2008 | Drel et al. | 84/612 |
| 2009/0272253 | A1 * | 11/2009 | Yamashita et al. | 84/611 |

OTHER PUBLICATIONS

Mainka, "StepMan—matching music to your moves", Jan. 2004, CG Topics.

"Honor for StepMan in the Design Competition the mVs 2004," downloaded Oct. 20, 2004, http://216.239.37.104/translate_c?hl=en &sl=de&u=http://www.innovations-report.de/htm....

Szabo et al., "The Effects of Slow-and Fast-Rhythm Classical Music on Progressive Cycling to Voluntary Physical Exhaustion", Sep. 1999, The Journal of Sports Medicine and Physical Fitness, pp. 220-225.

* cited by examiner

*Primary Examiner* — Jeffrey Donels

(57) ABSTRACT

Methods for beat synchronization between media assets are described. In one embodiment, beat synchronized media mixes can be automatically created. By way of example, a beat synchronized event mix can be created by selecting a plurality of media assets, arranging the media assets into an unsynchronized media mix, determining the a profile of each of the media assets in the media mix, automatically beat-matching the beats of adjacent media assets in the media mix, and automatically beatmixing the beats of adjacent beat-matched media assets to create the beat-synchronized media mix. The media assets that can be used include both audio and video media. Media assets are selected based on a specific set of media asset selection criteria, which can include music speed or tempo, music genre, music intensity, media asset duration, user rating, and music mood. A beat synchronized event mix can be subdivided into one or more event mix segments. Each event mix segment can have its own selection criteria.

28 Claims, 12 Drawing Sheets

(a)

(b)

METHOD FOR CREATING A BEAT-SYNCHRONIZED MEDIA MIX

CROSS REFERENCE TO OTHER APPLICATIONS

This application references U.S. patent application Ser. No. 10/997,479, filed Nov. 24, 2004, and entitled "MUSIC SYNCHRONIZATION ARRANGEMENT," which is hereby incorporated herein by reference.

BACKGROUND OF THE INVENTION

1. Field of the Invention

In general, the invention relates to methods for beat synchronization between media assets, and, more particularly, to the automated creation of beat synchronized media mixes.

2. Description of the Related Art

In recent years, there has been a proliferation of digital media players (i.e., media players capable of playing digital audio and video files.) Digital media players include a wide variety of devices, for example, portable devices, such as MP3 players or mobile phones, personal computers, PDAs, cable and satellite set-top boxes, and others. One example of a portable digital music player is the Ipod® manufactured by Apple Inc. of Cupertino, Calif.

Typically, digital media players hold digital media assets (i.e., media files) in internal memory (e.g., flash memory or hard drives) or receive them via streaming from a server. These media assets are then played on the digital media player according to a scheme set by the user or a default scheme set by the manufacturer of the digital media player or streaming music service. For instance, a media player might play media assets in random order, alphabetical order, or based on an arrangement set by an artist or record company (i.e., the order of media assets on a CD). Additionally, many media players are capable of playing media assets based on a media playlist. Media playlists are usually generated by a user, either manually or according to a set of user-input criteria such as genre or artist name.

Digital media assets can be any of a wide variety of file types, including but not limited to: MPEG-1 Layer 2, MPEG-1 Layer 3 (MP3), MPEG-AAC, WMA, Dolby AC-3, Ogg Vorbis, and others. Typically, media assets that have been arranged in media playlists are played with a gap between the media assets. Occasionally, more sophisticated media playing software will mix two media assets together with a rudimentary algorithm that causes the currently playing media asset to fade out (i.e., decrease in volume) while fading in (i.e., increasing in volume) the next media asset. One example of media playing software that includes rudimentary mixing between subsequent media assets is Itunes® manufactured by Apple Inc. of Cupertino, Calif.

However, there is a demand for more sophisticated mixing techniques between media assets than is currently available. For instance, no currently available media playing software is capable of automatically synchronizing the beats between two or more media assets.

Beat synchronization is a technique used by disc jockeys (DJs) to keep a constant tempo throughout a set of music. Beat synchronization is accomplished in two steps: beatmatching (adjusting the tempo of one song to the tempo of another) and beatmixing (lining up the beats of two beatmatched songs.)

Originally, beatmatching was accomplished by counting the beats in a song and averaging them over time. Once the tempo of the song (expressed in beats per minute (BPM)), was determined, other songs with the same tempo could be strung together to create a music set. In response to a demand for more flexibility in creating their music sets, record players (also known as turntables) with highly adjustable speed controls were employed. These adjustable turntables allowed the DJ to adjust the tempo of the music they were playing. Thus, a DJ would play a song with a particular tempo, and adjust the tempo of the next song such that the two songs could be seamlessly beatmixed together. A DJ would use headphones, a sound mixer, and two turntables create a 'set' of music by aligning the beats of subsequent songs and fading each song into the next without disrupting the tempo of the music. Currently, manually beatmatching and beatmixing to create a beat-synchronized music mix is regarded as a basic technique among DJs in electronic and other dance music genres.

However, dance club patrons are not the only people who value beat-synchronized music mixes. Currently, many aerobics and fitness instructors use prepared beat-synchronized music mixes to motivate their clients to exercise at a particular intensity throughout a workout. Unfortunately, using the techniques of beatmatching and beatmixing to create a beat-synchronized music mix requires a great deal of time, preparation, and skill, as well as sophisticated equipment or software. Thus, music lovers wishing to experience a dance club quality music mix must attend a dance club or obtain mixes prepared by DJs. In the case of fitness instructors who want to use beat-synchronized music mixes, rudimentary DJ skills must be learned or previously prepared beat-synchronized music mixes must be purchased to play during their workouts.

Currently, even in the unlikely event that a consumer is able to obtain a pre-selected group of beatmatched media assets (i.e., each media asset has the same tempo as the rest) from a media provider, the transitions between media assets are not likely to be beat-synchronized when played. This is because current media players lack the capability to beatmix songs together. Further, even if a group of songs has the same average tempo, it is very likely that at least some beatmatching will have to be performed before beatmixing can occur. Thus, there is a demand for techniques for both automated beatmatching and automated beatmixing of media.

Even professional DJs and others who desire to put together beat-synchronized mixes often have to rely on their own measurements of tempo for determining which songs might be appropriate for creating a beat-synchronized mix. In some instances, the tempo of a song might be stored in the metadata (e.g., the ID3 tags in many types of media assets), but this is by no means common. Thus there is a demand for automated processing of a collection of media assets to determine the tempo of each media asset.

It should be noted that, even in electronic music, which often has computer generated rhythm tracks, the tempo is often not uniform throughout the track. Thus, it is common for music to speed up and/or slow down throughout the music track. This technique is used, for example, to alter mood, to signal a transition to a song chorus, or to build or decrease the perceived intensity of the music. This effect is even more pronounced in non-electronic music, where the beat is provided by musicians rather than computers, and who may vary the speed of their performances for aesthetic or other reasons. For example, it common practice for a song to slow down as it ends, signaling to the listener that the song is over. Speed variations may be very subtle and not easily perceptible to human ears, but can be significant when creating a beat-synchronized music mix. Thus, conventional tempo measuring techniques which output a single number to represent the tempo of the track actually output an average BPM, which can be misleading to someone who is looking for a song segment (such as the beginning or end of a song) with a particular tempo. Thus there is a demand for more complete descriptions of tempo throughout a media asset.

Further still, not everyone who wants a beat-synchronized music mix is knowledgeable or interested enough to use tempo as a criterion for selecting media. Thus, there is a demand for creating a beat-synchronized music mix based on other, subjective or objective criteria, for example, the perceived intensity or genre of the music.

Accordingly, there is a demand for new methods for automatically selecting music or other media for and creating beat-synchronized media mixes. Further, there is a demand for the creation of a beat-profile for any given media asset, as opposed to conventional average tempo measurements.

SUMMARY OF THE INVENTION

The invention pertains for techniques for creating beat-synchronized media mixes, using audio and/or video media assets. More specifically, the invention pertains to techniques for creating beat-synchronized media mixes based on user related criteria such as BPM, intensity, or mood.

Beat-synchronized media mixes can be created for a wide variety of different events. The term 'event', in the context of this description, refers to a planned activity for which the media mix has been created. For instance, one possible event is a workout. If the user desires a 'workout mix' to motivate himself and/or pace his workout, then he can create a workout mix according to his specifications (e.g., workout mode). Another event is a party, where the user desires a party mix to keep her guests entertained. In this case, the party mix can be dynamically created as in automated disc jockey (auto DJ mode). Note that a beat-synchronized mix can be planned for any event with a duration. Further, a beat-synchronized mix can continue indefinitely in an auto DJ mode.

In one embodiment of the invention, the creation of a beat-synchronized media mix can be fully automated based on a user's high-level specification or can be more closely managed (e.g., manually managed) to whatever extent the user wishes. A 'high-level' specification from a user could be something as simple as specifying a genre or mood to use when creating the beat-synchronized media mix. Other high-level criteria that can be specified include artist names, music speeds expressed in relative terms (e.g., fast tempo), media mix duration, media mix segment durations, and numerical BPM ranges.

Should a user desire more control over the media mix, a more complete specification can be supplied. For instance, a music tempo can be specified over a period of time. Alternately, a playlist of music suitable for the creation of a beat-synchronized media mix can be specified. Further, a series of beat-synchronized media mixes can be created and strung together in mix segments. For instance, say a user wishes to create a workout mix that includes a warm-up mix segment at one tempo, a main workout mix segment at a second tempo, and a cool down mix segment at a third tempo. In one embodiment of the invention, three separate beat synchronized media mixes are created. Each of the three beat-synchronized media mixes becomes a mix segment of the workout mix. According to this embodiment of the invention, each mix segment of the workout mix is beat-synchronized. However, the transitions between subsequent segments are not beat-synchronized for aesthetic reasons due to the disparity in the tempo between the two segments. Alternately, if the user wishes, subsequent segments can be beat-synchronized between segments, even if the tempo disparity between the two segments is great. One way to beat-synchronize between two mix segments with widely different tempos is by partial synchronization. Ideally, partial synchronization occurs when the tempo of one mix segment is close to an integer multiplier of the tempo of other mix segment (e.g., double, triple, or quadruple speed.) In this case, the beats are synchronized by skipping beats in the faster mix segment. For example, if the tempo of the faster mix segment is twice the tempo of the slower mix segment, then each beat of the slower mix segment can be beatmatched to every other beat of the faster mix segment before beatmixing the two segments together. A second way to beat-synchronize two mix segments with widely different tempos is simply to gradually or rapidly change the tempo of the current mix segment to match the tempo of the upcoming mix segment just before the transition between mix segments.

In another embodiment of the invention, the media mix can be controlled by receiving data from sensors such as heartbeat sensors or pedometers. In this embodiment, music in the media mix can be sped up or slowed down in response to sensor data. For example, if the user's heart rate exceeds a particular threshold, the tempo of the media mix can be altered in real-time. In another example, if a pedometer is being used to track pace, the media mix can automatically adjust its tempo as a method of feedback to the listener.

In still another embodiment of the invention, a beat synchronized event mix is created by selecting a plurality of media assets, arranging the media assets into an unsynchronized media mix, determining the a profile of each of the media assets in the media mix, automatically beatmatching the beats of adjacent media assets in the media mix, and automatically beatmixing the beats of adjacent beatmatched media assets to create the beat-synchronized media mix. The media assets that can be used include both audio and video media. Examples of audio media assets include, but are not limited to: MPEG-1 Layer 2, MPEG-1 Layer 3 (MP3), MPEG-AAC, WMA, Dolby AC-3, and Ogg Vorbis. Media assets are selected based on a specific set of media asset selection criteria, which can include music speed or tempo, music genre, music intensity, media asset duration, user rating, and music mood. A beat synchronized event mix can be subdivided into one or more event mix segments. Each event mix segment can have its own selection criteria.

In another embodiment of the invention, a pair of media assets are beat synchronized by determining the beat profile of the first of the paired media assets, determining the beat profile of the second of the paired media assets, automatically adjusting the speed of the first of the paired media assets to match the speed of the second of the paired media assets, determining the beat offset of the second of the paired media assets, automatically offsetting the second media asset by the beat offset, and automatically mixing the pair of media assets together.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Figure 1:
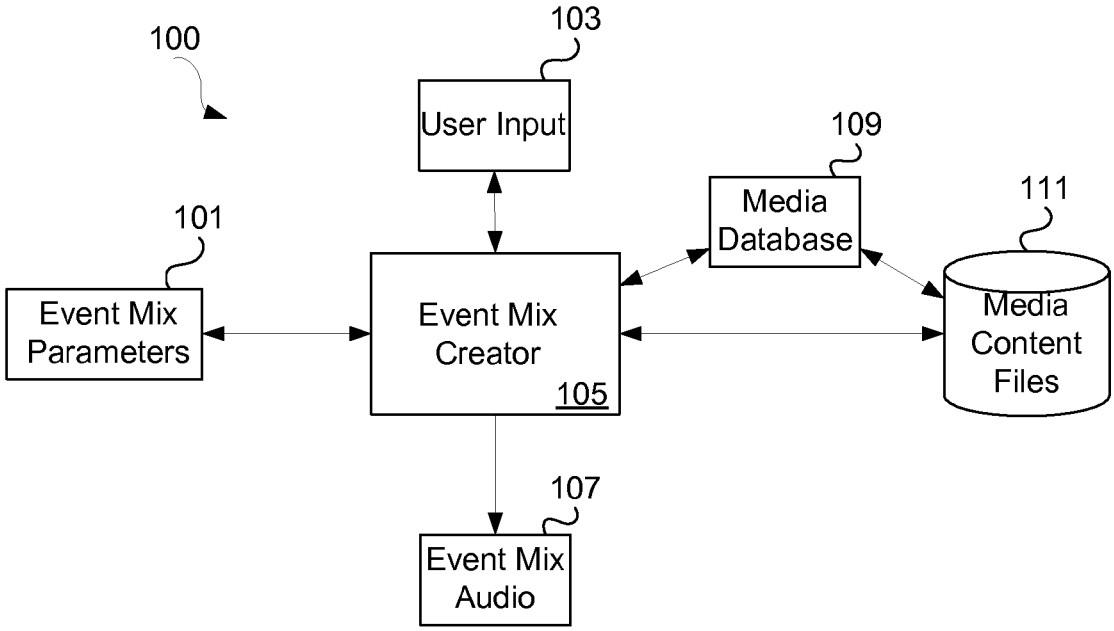
FIG. 1 is a block diagram of a system for creating event mixes according to one embodiment of the invention.

The invention pertains for techniques for creating beat-synchronized media mixes, using audio and/or video media assets. More specifically, the invention pertains to techniques for creating beat-synchronized media mixes based on user related criteria such as BPM, intensity, or mood.

Beat-synchronized media mixes can be created for a wide variety of different events. The term 'event', in the context of this description, refers to a planned activity for which the media mix has been created. For instance, one possible event is a workout. If the user desires a 'workout mix' to motivate himself and/or pace his workout, then he can create a workout mix according to his specifications (e.g., workout mode). Another event is a party, where the user desires a party mix to keep her guests entertained. In this case, the party mix can be dynamically created as in automated disc jockey (auto DJ mode). Note that a beat-synchronized mix can be planned for any event with a duration. Further, a beat-synchronized mix can continue indefinitely in an auto DJ mode.

In one embodiment of the invention, the creation of a beat-synchronized media mix can be fully automated based on a user's high-level specification or can be more closely managed (e.g., manually managed) to whatever extent the user wishes. A 'high-level' specification from a user could be something as simple as specifying a genre or mood to use when creating the beat-synchronized media mix. Other high-level criteria that can be specified include artist names, music speeds expressed in relative terms (e.g., fast tempo), media mix duration, media mix segment durations, and numerical BPM ranges.

Should a user desire more control over the media mix, a more complete specification can be supplied. For instance, a music tempo can be specified over a period of time. Alternately, a playlist of music suitable for the creation of a beat-synchronized media mix can be specified. Further, a series of beat-synchronized media mixes can be created and strung together in mix segments. For instance, say a user wishes to create a workout mix that includes a warm-up mix segment at one tempo, a main workout mix segment at a second tempo, and a cool down mix segment at a third tempo. In one embodiment of the invention, three separate beat synchronized media mixes are created. Each of the three beat-synchronized media mixes becomes a mix segment of the workout mix. According to this embodiment of the invention, each mix segment of the workout mix is beat-synchronized. However, the transitions between subsequent segments are not beat-synchronized for aesthetic reasons due to the disparity in the tempo between the two segments. Alternately, if the user wishes, subsequent segments can be beat-synchronized between segments, even if the tempo disparity between the two segments is great. One way to beat-synchronize between two mix segments with widely different tempos is by partial synchronization. Ideally, partial synchronization occurs when the tempo of one mix segment is close to an integer multiplier of the tempo of other mix segment (e.g., double, triple, or quadruple speed.) In this case, the beats are synchronized by skipping beats in the faster mix segment. For example, if the tempo of the faster mix segment is twice the tempo of the slower mix segment, then each beat of the slower mix segment can be beatmatched to every other beat of the faster mix segment before beatmixing the two segments together. A second way to beat-synchronize two mix segments with widely different tempos is simply to gradually or rapidly change the tempo of the current mix segment to match the tempo of the upcoming mix segment just before the transition between mix segments.

In another embodiment of the invention, the media mix can be controlled by receiving data from sensors such as heartbeat sensors or pedometers. In this embodiment, music in the media mix can be sped up or slowed down in response to sensor data. For example, if the user's heart rate exceeds a particular threshold, the tempo of the media mix can be altered in real-time. In another example, if a pedometer is being used to track pace, the media mix can automatically adjust its tempo as a method of feedback to the listener.

FIG. 1 is a block diagram of an event mix creation system 100 according to one embodiment of the invention. An event mix is a media mix for a particular event. Examples of event mixes include workout mixes or a DJ mix sets. The event mix creation system 100 can be, for example, a software program running on a personal computer that a user interacts with to create an event mix of their choosing.

In order to create an event mix, event mix parameters 101 are entered into the event mix creator 105. These parameters can be manually entered by the user or can be pre-generated by, for instance, a personal trainer. Another input into the event mix creator 105 is user input 103. User input 103 can be, for example, a user selecting from a list of media assets that are available to create the event mix. Alternately, user input 103 can be the output of a heartbeat sensor or pedometer. Additionally, the event mix creator 105 can access a media database 109 and media content file storage 111 in order to create the event mix. According to one embodiment of the invention, the media database 109 is a listing of all media files accessible by the event mix creator 105. The media database 109 may be located, for example, locally on a personal computer, or remotely on a media server or media store. Online media databases can include databases that contain media metadata (i.e., data about media), such as Gracenote®, or online media stores that contain both metadata and media content. One example of an online media store is the iTunes® online music store. Media content file storage 111 can be any storage system suitable for storing digital media assets. For instance, media content file storage 111 can be a hard drive on a personal computer. Alternately, media content file storage 111 can be located on a remote server or online media store.

Figure 2:
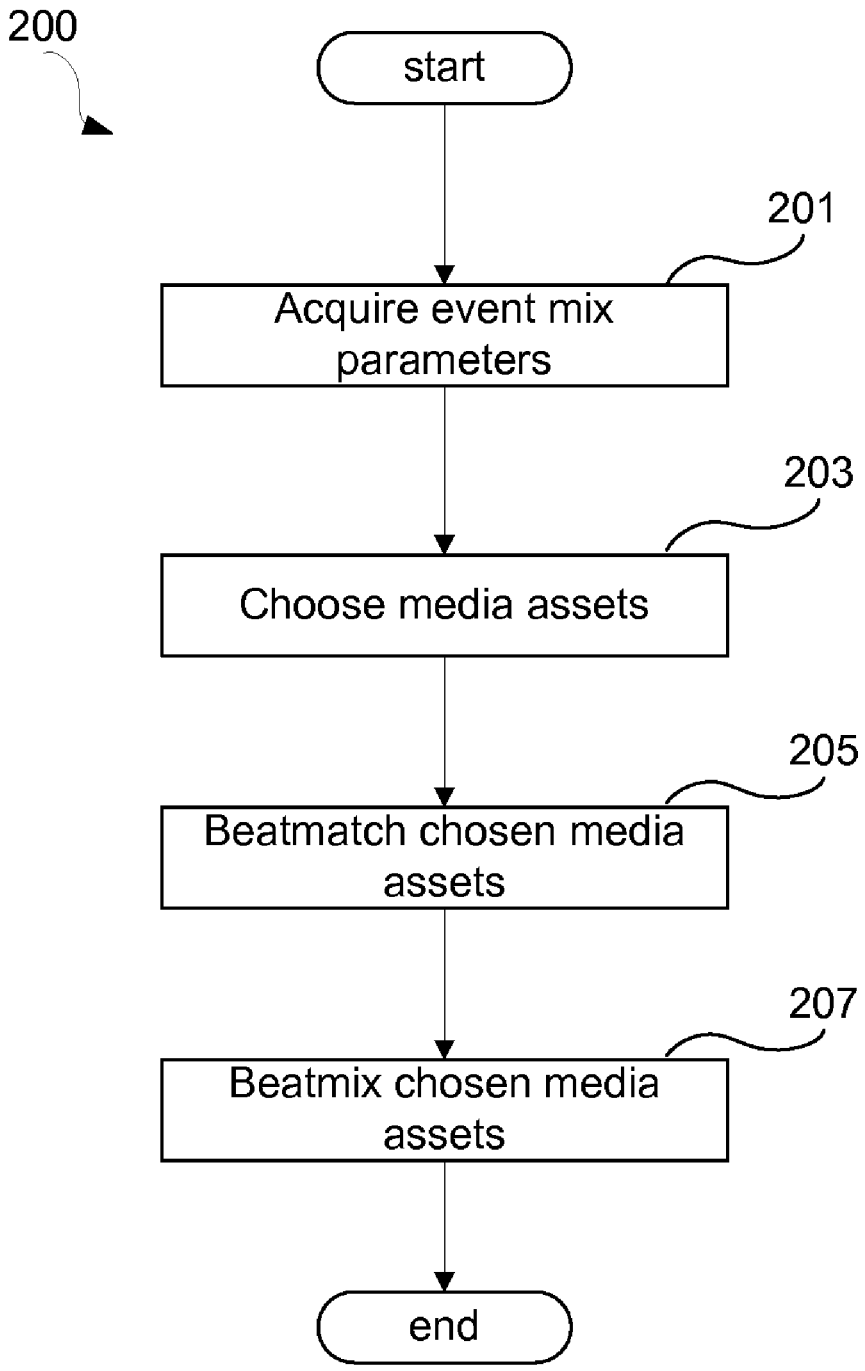
FIG. 2 is a flow diagram of an event mix creation process according to one embodiment of the invention.

FIG. 2 is a flow diagram of an event mix creation process 200 according to one embodiment of the invention. The event mix creation process 200 can be accomplished, for example, by using the event mix creation system 100 described in FIG. 1.

The event mix creation process 200 begins with acquiring 201 the event mix parameters for the desired event mix. In one embodiment of the invention, acquiring 201 is accomplished manually by the person wishing to create the event mix interacting with a software program that creates the event mix. In another embodiment, the event mix parameters are acquired 201 by loading a specification prepared previously by, for example, a personal trainer. Other sources of previously prepared event mix parameters can include, for example, downloadable user generated playlists, published DJ set lists, or professionally prepared workout programs. These parameters can include a wide variety of information that will be used in the creation of the event mix. Some appropriate parameters include a list of genres or artists to use in the event mix, the number of event mix segments in the event mix, the tempo of each event mix segment (expressed in relative terms such as intensity or absolute terms such as BPM), heart rate targets for use with a heart rate sensor during the event, or pace information in terms of steps per minute for a workout that includes walking or running. Other parameters are possible as well. Next, media assets are chosen 203 according to the event mix parameters. According to one embodiment of the invention, media assets are chosen from the user's media asset library, for example, the media assets on the user's hard drive. Alternately, the media assets are chosen 203 from an online media asset database or online media store. The media assets are chosen 203 such that they can be beatmixed and beatmatched without extensive tempo adjustment, if at all possible. For example, if the event parameters specify a tempo in BPM, then all media assets that are chosen 203 are similar in tempo to the specified tempo. The similarity of the tempo can be set by the user or preset in the software used to create the event mix. According to one embodiment of the invention, if the user's media collection does not have a sufficient number of media assets with tempos near the specified tempo, then media assets with greater tempo differences can be chosen 203. Alternately, if the user's media collection does not have a sufficient number of media assets with tempos near the specified tempo, then media assets with the specified tempo can be recommended for the user, and made available for purchase by the user from an online media store. The media assets that are made available can be selected based on tempo, genre, other user's ratings, or other selection criteria. For example, if other users have rated songs as "high intensity workout" songs suitable for workout mixes, and the user does not have those as a part of the user's media collection, then those songs can be made available for purchase. In still another embodiment of the invention, even if the user has a sufficient number of media assets within the specified tempo range, the user may obtain recommendations from an online media store for additional or alternate media assets for use in the event mix.

Once media assets have been chosen 203, they are beatmatched 205 according to the event parameters. In one embodiment of the invention, all media assets that have been chosen 203 are given a uniform tempo corresponding to the tempo given in the event mix parameters. In another embodiment, beatmatching 207 is performed gradually over the course of the entire event mix. Next, the beatmatched media assets are beatmixed 207 together. This is accomplished by lining up the beats between subsequent media assets such that they are synchronized over the mix interval (i.e., the time period when one media asset is fading out while the next is fading in,) and the event mix creation process 200 ends.

Figure 3:
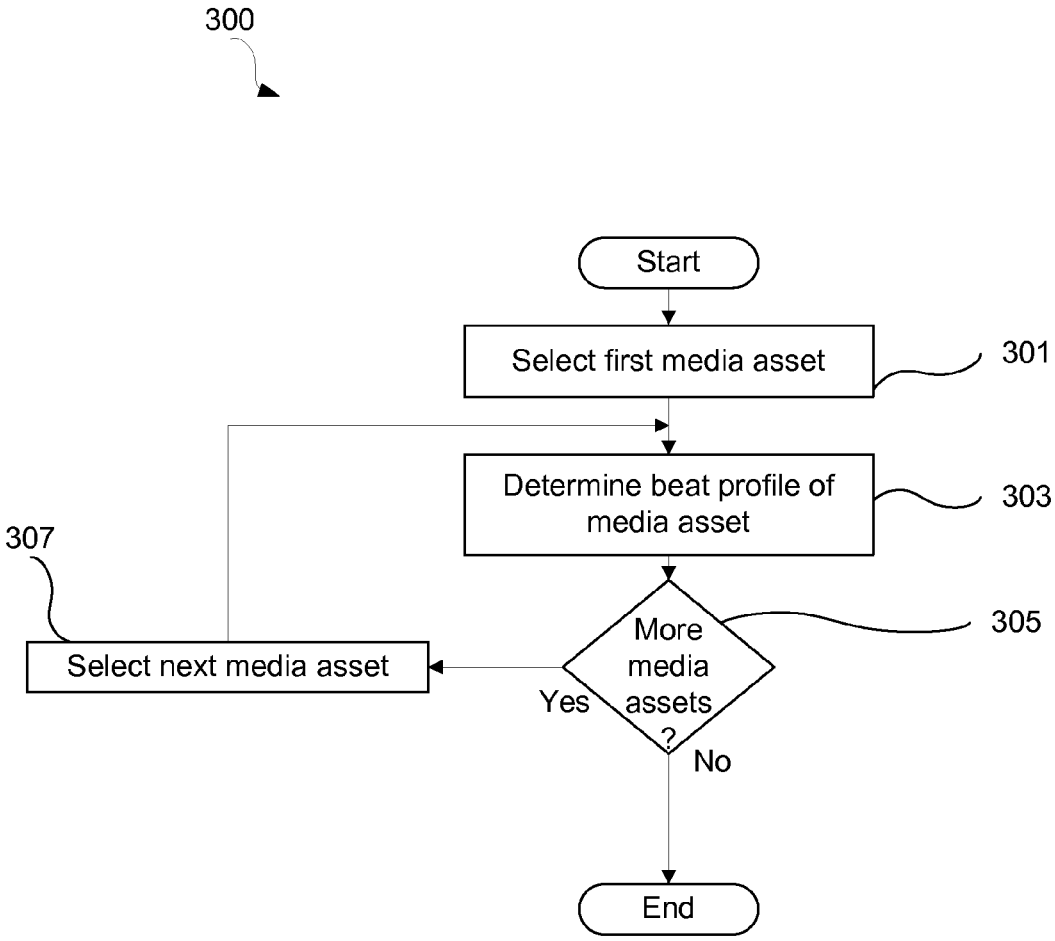
FIG. 3 is a flow diagram of a beat profile determining process according to one embodiment of the invention.

FIG. 3 is a flow diagram of a beat profile determining process 300 according to one embodiment of the invention. The beat profile determining process can provide detailed tempo information throughout a media asset, rather than simply providing an average BPM measure. The beat profile obtained using the beat profile determining process 300 can be used, for example, to aid in the choosing 203, beatmatching 205, and beatmixing 207 of media assets as described above in reference to FIG. 2. The beat profile determining process 300 can, for example, be performed on media assets in a media asset collection (e.g., the media assets stored on a personal computer) before the beat profile is needed, performed before a media asset is sold or distributed, or performed on demand. Further, the beat profile determining process 300 can store the determined beat profile in the metadata headers of a media asset (e.g., the ID3 tags of an MP3), or in a separate location, such as a local or online database.

The beat profile determining process 300 begins with selecting 301 the first media asset in a collection of media assets. The collection of media assets can, for example, be the media assets chosen 203 in FIG. 2. Alternately, the collection of media assets can be any subset of a user's music collection such as a single media asset, a group of media assets on a playlist, or a user's entire media asset collection. Next, the beat profile of the selected media asset is determined 303, using any suitable beat-locating algorithm. Beat-locating algorithms are well known in the art and are not discussed in this application. According to one embodiment of the invention, the beat profile is determined 303 for the entire duration of the selected media asset. Variations in tempo within the selected media asset are recorded in the beat profile, such that a substantially complete record of the location of the beats in the selected media asset is created. According to another embodiment of the invention, the beat profile is only determined 303 for the beginning and end segments of the selected media assets. This second embodiment has the advantage of storing only the minimum information needed to beatmatch and beatmix media assets together, saving computational time and reducing the storage space required to store beat profiles for any given media asset. The beat profile determining process 300 continues with decision 305, which determines if there are more media assets to be examined. If decision 305 determines that more media assets are to be examined, then the beat profile determining process 300 continues by selecting 307 the next media asset in the collection of media assets and returning to block 303 and subsequent blocks. If, on the other hand, decision 305 determines that no more media assets are to be examined, the beat profile determining process 300 ends.

Figure 4:
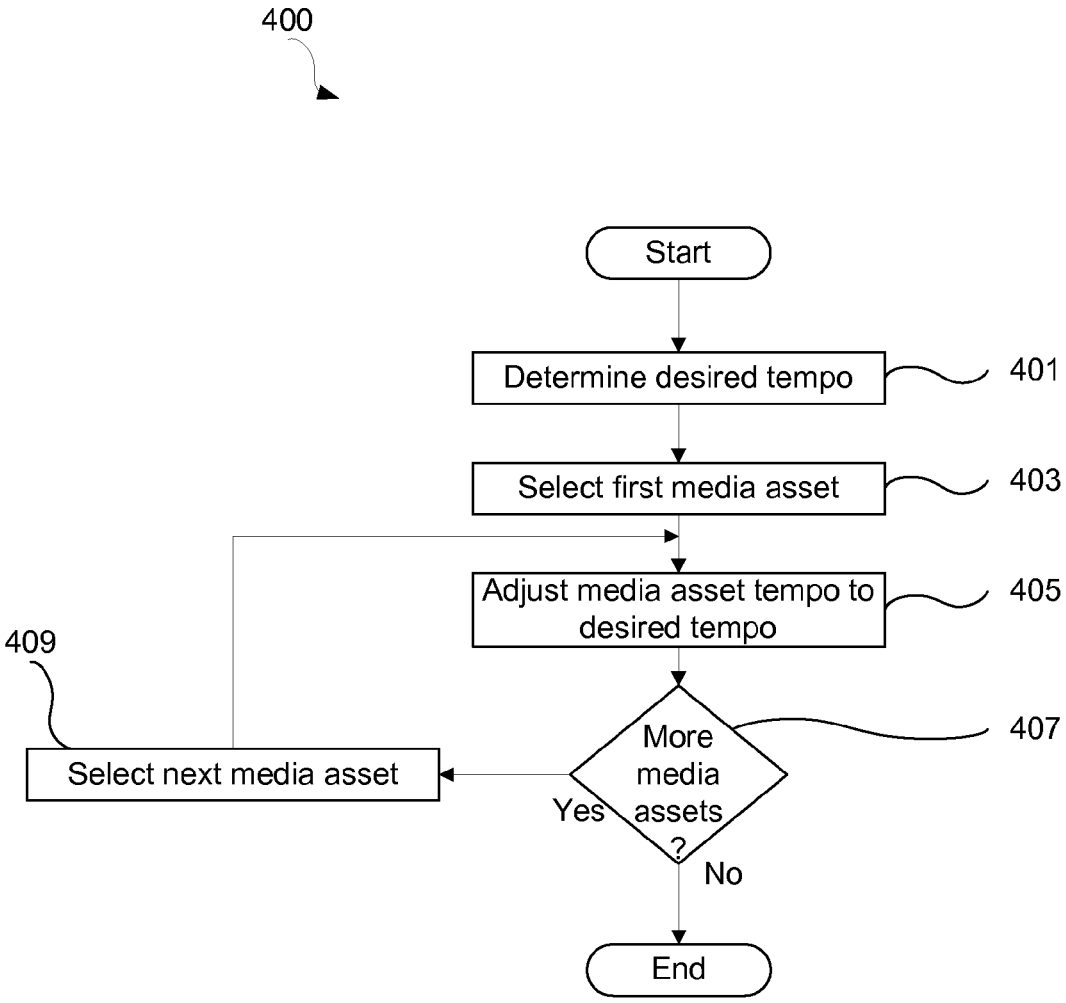
FIG. 4 is a flow diagram of a beatmatching process according to one embodiment of the invention.

FIG. 4 is a flow diagram of a beatmatching process 400 according to one embodiment of the invention. The beatmatching process 400 is used to adjust the tempo of one or more media assets such that they can be mixed together. Typically, beatmatching is done on two media assets at a time, such that the two assets can be beatmixed together. However, beatmatching can be done on any number of media assets. The beatmatching process 400 can be, for example, the beatmatching 207 of FIG. 2.

The beatmatching process 400 begins with determining 401 a desired tempo. This determining 401 can be made, for example, by examining the event parameters acquired 201 in FIG. 2. Alternately, in the case when a media asset is currently selected and playing, the determining 401 can occur in real time by examining the beat profile of a currently playing media asset and using the tempo of that media asset in the determination 401. Next, a first media asset is selected 403 from a group of media assets that require beatmatching. The media asset is then adjusted 405 such that that media asset's tempo is the same as the desired tempo. According to one embodiment of the invention, the tempo of the entire media asset is adjusted 405. In another embodiment, only the end of the selected media asset is adjusted. Next, a decision 407 determines if there are more media assets that need to be adjusted 405. If so, the next media asset in the group of media assets is selected 409 and the beatmatching process 400 continues to block 405 and subsequent blocks. On the other hand, if the decision 407 determines that there are no more media assets to adjust 405, the beatmatching process 400 ends.

Figure 5:
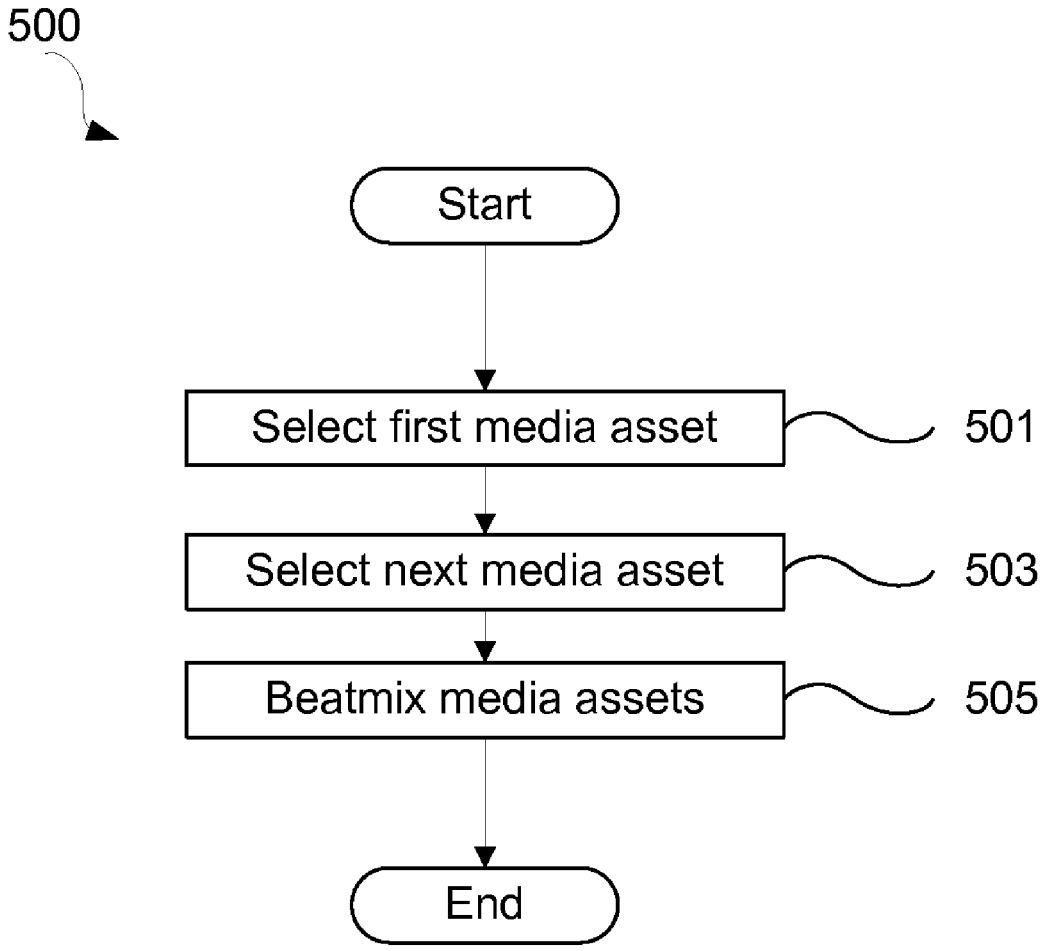
FIG. 5 is a flow diagram of a beatmixing process according to one embodiment of the invention.

FIG. 5 is a flow diagram of a beatmixing process 500 according to one embodiment of the invention. The beatmixing process 500 is used to mix any two media assets that have substantially identical tempos together; much like a DJ mixes songs together in a dance club. In other words, the beatmixing process 500 mixes together any two beatmatched media assets, for example, two media assets that have been beatmatched using the beatmatching process 400 of FIG. 4.

The beatmixing process 500 begins with selecting 501 a first media asset of a pair of media assets that are to be beatmixed together. Next, a second media asset is selected 503. Third, the two media assets are beatmixed 505 together. As discussed above, beatmixing involves synchronizing the beats of the first and second media assets and then fading the first media asset out while fading the second media asset in. The time over which the first media asset fades into the second is the media asset overlap interval. Typically this media asset overlap interval is several seconds long, for example five seconds. Other media asset overlap intervals are possible.

Figure 6:
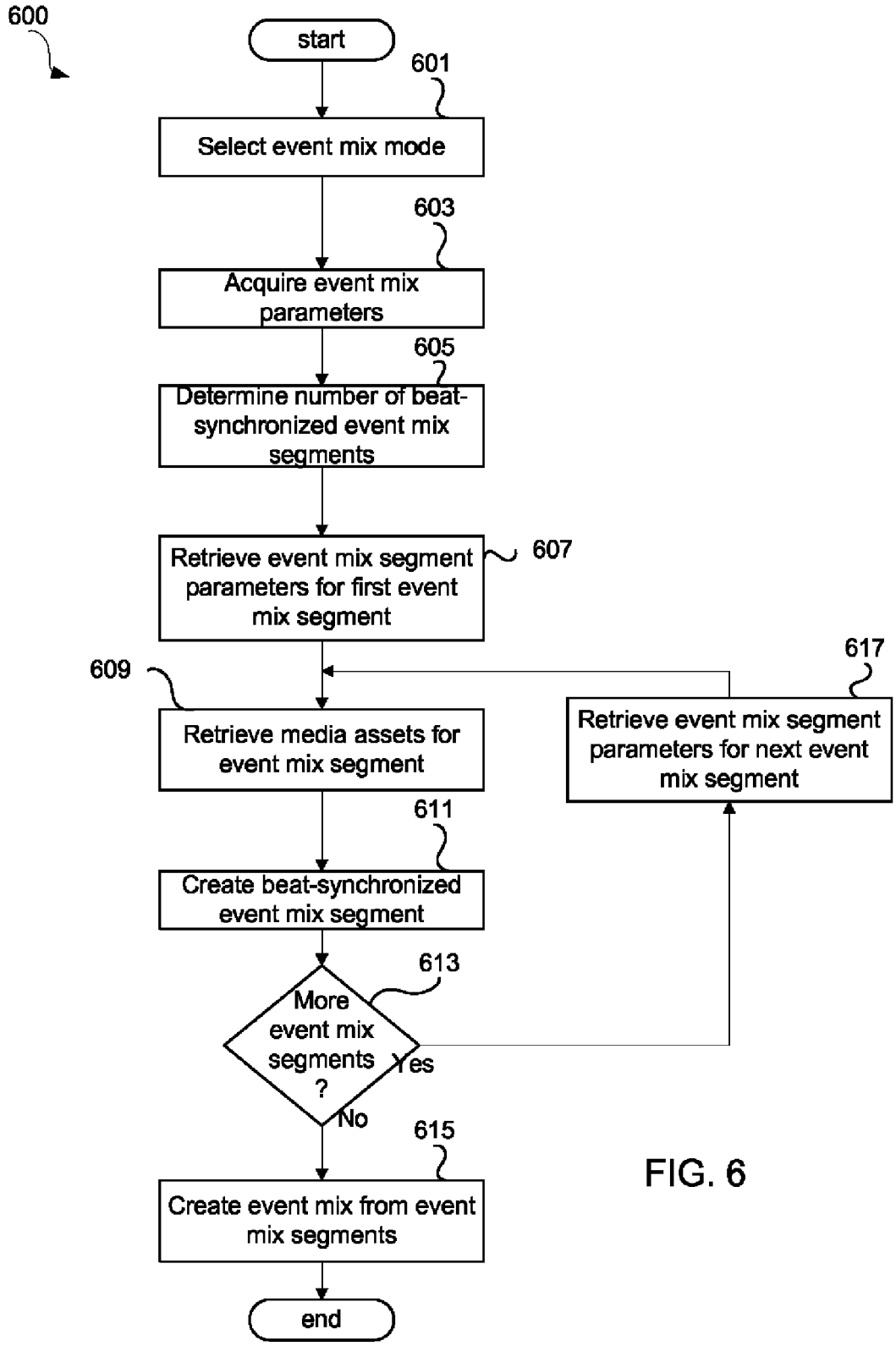
FIG. 6 is a flow diagram of an event mix creation process according to one embodiment of the invention.

FIG. 6 is a flow diagram of an event mix creation process 600 according to one embodiment of the invention. The event mix creation process 600 can be accomplished by using, for example, the event mix creation system 100 of FIG. 1.

The event mix creation process 600 begins by selecting 601 an event mix mode. As discussed above, the event can be any number of different types, for example a workout or DJ set. Thus, each event mix mode type corresponds to a type of event. Event mode types include, for example, a DJ mode, a workout mode, and a timed event mode. Other modes are possible. Next, event mix parameters are entered 603 in order to create the event mix. The event parameters can be, for example, the event parameters acquired 201, as described in FIG. 2. As discussed above, the event parameters can include event length, music genre preferences, musical artist preferences, specific user ratings to use for the event mix, as well as other parameters such as media asset overlap interval. Another mix parameter can be a playlist of media assets to use in the event mix. At the time the event mix parameters are entered, the event parameters can be specified for any number of event mix segments. Next, the number of synchronized event mix segments is determined 603. Each synchronized event segment includes a set of songs that have been beatmatched and beatmixed together. As discussed above, event mix segments may or may not be mixed into each other. Rather, at an event mix segment transition, the next mix segment can start as the previous mix segment ends. Each event mix segment can have a different tempo, as well as event mix segment specific duration, tempo, and music preferences. The tempo parameter can be specified either subjectively, for example low, medium, or high intensity, or expressed in BPM. One example of an event mix with multiple event segments is a workout, where a warm-up segment, a main workout segment, and a cooldown segment are specified, each with its own duration, tempo, genre, song, and artist preference. Another example of an event mix with multiple mix segments is a DJ mix, where each segment corresponds to a significant change in tempo or music genre.

Next, the parameters for the first event mix segment are retrieved 605 so that the event mix segment can be constructed. The media assets to be used in the creation of the mix segment are then retrieved 607 and created 611. The creation 611 of the beat-synchronized event mix segment can correspond, for example, to the beatmatching 207 and beatmixing 209 described in FIG. 2. Once the first event mix segment has been created, a decision 613 determines if more event mix segments are to be created 611. If so, the event mix creation process 600 continues by retrieving 615 the event mix segment parameters for the next mix segment. Once the event mix segment parameters have been retrieved 615, the event mix creation process 600 returns to block 609 and subsequent blocks. On the other hand, if the decision 613 determines that there are no more event mix segments to be created 611, the event mix creation process 600 creates 617 the complete event mix from the previously created 611 event mix segments.

According to one embodiment of the invention, the completed event mix can be a 'script' that describes to a media player how to beat-synchronize a playlist of music. In another embodiment, the event mix is created as a single media asset without breaks. One advantage of this embodiment is that any media player can play the event mix even if it does not have beat-synchronization capabilities.

Figure 7:
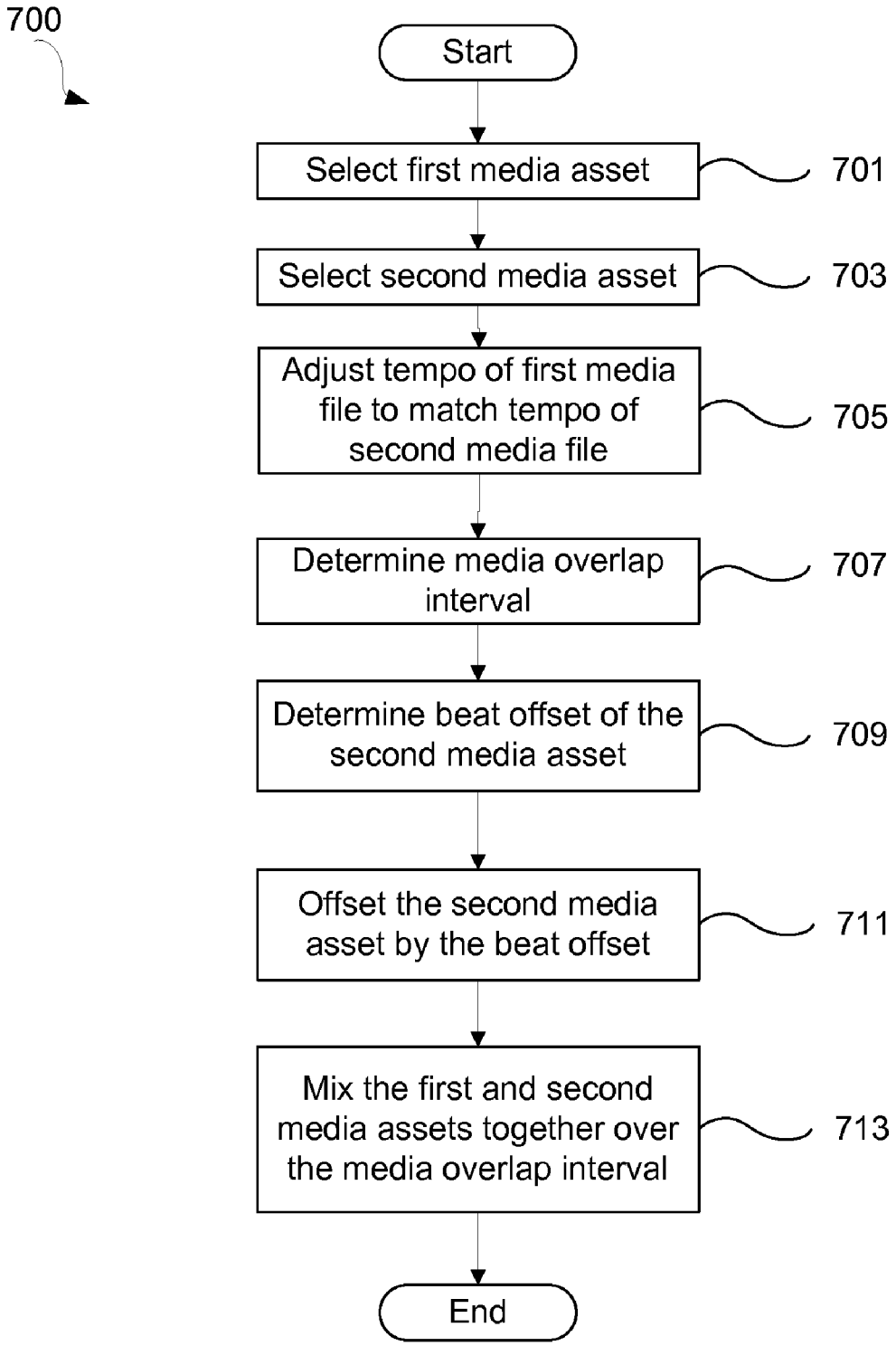
FIG. 7 is a flow diagram of a beat-synchronization process according to one embodiment of the invention.

FIG. 7 is a flow diagram of an exemplary beat-synchronization process 700 according to one embodiment of the invention. The beat synchronization process 700 can correspond to the beatmatching 207 and beatmixing 209 of FIG. 2. According to this embodiment of the invention, the beat-synchronization occurs between two media assets.

The beat-synchronization process 700 begins with the selection 701 of a first media asset, for example a music file or music video file, followed by the selection 703 of a second media asset. Next, the tempo of the first media asset is adjusted 705 to match the tempo of the second media asset. In a second embodiment of the invention (not shown), the tempo of the second media asset is adjusted to match the tempo of the first media asset. Once the tempo of the first media asset has been adjusted 705, the media overlap interval is determined 707. The media overlap interval is the time segment during which both media assets are playing—typically, the first media asset is faded out while the second media asset is faded in over the media overlap interval. The media overlap interval can be of any duration, but will typically be short in comparison to the lengths of the first and second media assets. The media overlap interval can be specified in software or can be a default value, for example five seconds.

In order to properly align the beats of the first and second media asset, the beat offset of the second media asset is determined 709 next. The beat offset corrects for the difference in beat locations in the first and second media asset over the media overlap interval. For instance, say the media overlap interval is 10 seconds. If, at exactly 10 seconds from the end of the first media asset, the second media asset starts playing, it is likely that the beats of the second media asset will not be synchronized with the beats of the first media asset, even if the tempo is the same. Thus, it is very likely that there will be a staggering of the beats between the two media asset (unless they accidentally line up, which is improbable.) The time between the beats of the first media asset and the staggered beats of the second media asset is the beat offset. Thus, in order to correctly line up the beats, the second media asset is offset 711 in time by the beat offset. Continuing with the example, say each beat in the second media asset hits one second later than the corresponding beat in the first media asset if the second media asset begins playing 10 seconds before the first media asset ends. In this case, the beat offset is one second. Thus, starting the second media asset one second earlier (i.e., 11 seconds before the first media asset ends), properly synchronizes the beats of the first and second media assets. Finally, the first and second media assets are mixed 713 together over the media overlap interval, for example by fading out the first media asset while fading in the second media asset.

Figure 8:
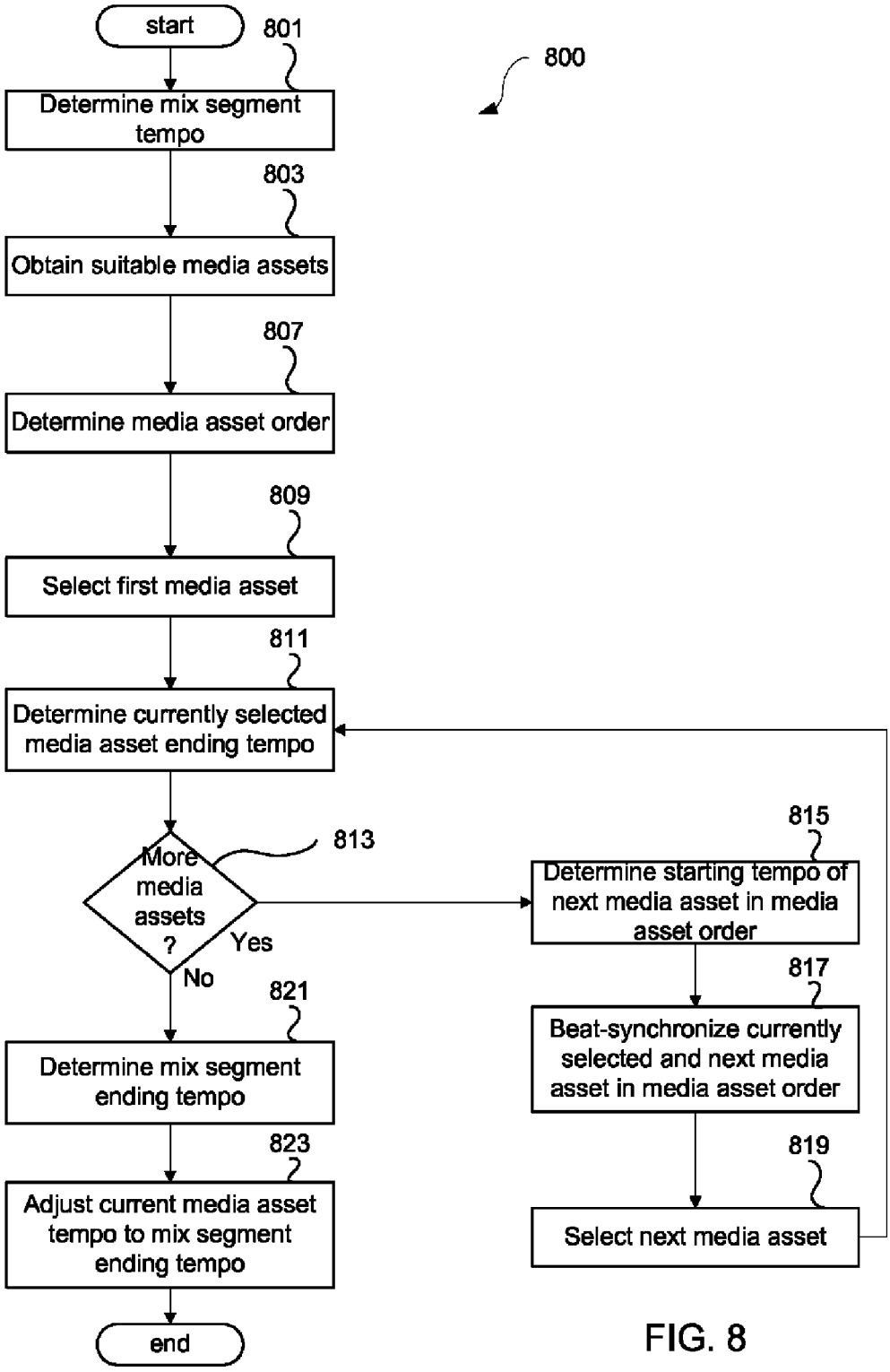
FIG. 8 is a flow diagram of an event mix segment creation process according to one embodiment of the invention.

FIG. 8 is a flow diagram of an event mix segment creation process 800 according to one embodiment of the invention. The event mix segment creation process 800 can be used, for example, in the creation 611 of a beat-synchronized event mix segment as described in FIG. 6. In addition to the event mix parameters discussed above, the event mix segment creation process 800 takes into consideration the event mix segment ending tempo, which allows for beat synchronization between event mix segments if desired. Alternately, the event mix ending tempo allows the event mix to end on the last media asset in an event mix at a specified tempo, rather than the tempo of the last media asset.

The event mix segment creation process 800 begins with determining 801 the event mix segment tempo. In one embodiment of the invention, the event mix segment tempo is one of the event parameters acquired 201 as described in FIG. 2. Once the event mix segment tempo is determined 801, suitable media assets are obtained 803. For instance, suitable media assets can have a specified tempo, a specified music genre, user rating or artist name, or can be selected from a playlist. Next, the order of the obtained media assets is determined 807, for example randomly. The obtaining 803 of media assets and the determining 807 of the order of the media assets for each event mix segment can for example, be implemented using a cheapest path or optimal path algorithm. In one embodiment of the invention media assets are selected by determining a 'cost' for each media asset for each position. The cost of a particular media asset is evaluated based on how close that particular asset is to a hypothetical perfect media asset for that particular position in the event mix segment. If a media asset is suitable for a particular position, then it is 'cheap'. If it is unsuitable, then it is 'expensive.' For example, say that an event mix segment is specified as ten minutes long, containing only disco songs of 'high' intensity. In this case, a nineteen minute long progressive rock piece would be 'expensive', since it does not meet the specified criteria. Any high intensity disco song of less than ten minutes would be relatively 'cheap' compared to the nineteen minute song. In this example, say the first song selected is a six minute long song. Since the event mix segment has been specified at ten minutes in length, more songs must be obtained. If there are two songs that are 'high intensity disco' to choose from, the cheapest path algorithm will select the one that is best to fill the four minutes left in the ten minute event mix segment. Thus, if the two songs are six minutes long and five minutes long, then the cheapest song (i.e., the one closest to four minutes) is the five minute song. Note that the event segment of this example is now eleven minutes long, one minute longer than specified. Various solutions can be envisioned such that the event mix segment is the specified length. In one embodiment of the invention, the event mix segment will end at the ten minute mark by fading out. In another embodiment of the invention, the media asset overlap interval is adjusted throughout the event mix segment such that the final media asset in the media mix segment stops playing at the actual end of the final media asset. Continuing with the above example, the eleven minute event mix segment can be shortened to ten minutes by mixing in the second, five minute disco song into the first, six minute, disco song five minutes into the first song.

The event mix creation process 800 continues by, selecting 809 the first media asset in the determined media asset order and determining 811 the selected media asset ending tempo. For example, the mix segment creation process 800 can have access to a beat profile of the selected media asset as determined by the beat profile determining process 300 described in FIG. 3. Alternately, the event mix segment creation process 800 can analyze the media asset in real time (i.e., as it is playing) in order to determine 811 its media asset ending tempo.

The event mix segment creation process 800 then determines 813 if there are more media assets in the media asset order. If there are more media assets in the media asset order, then the starting tempo of the next media asset in the starting order is determined 815 and used to adjust 817 the tempo of the currently selected media asset with the next media asset in the media asset order. The tempo adjustment 817 of the currently selected media asset can be, for example, the beat-synchronization process 700 described in FIG. 7. Next, the next media asset in the media asset order is selected 819 as the current media asset and the event mix segment creation process 800 continues to block 811 and subsequent blocks.

If, however, the decision 813 determines that there are no more media assets in the media asset order, then the event mix segment creation process 800 determines 821 the mix segment ending tempo. If the mix segment ending tempo is not specified, the mix segment ending tempo can default to the currently selected media asset ending tempo. Next, the ending tempo of the currently selected media asset is adjusted 823 as needed to match the mix segment ending tempo. As noted in the description of the tempo adjustment 817 above, the tempo adjustment 823 of the currently selected media asset can be, for example, the beat-synchronization process 700 described in FIG. 7.

Figure 9A:
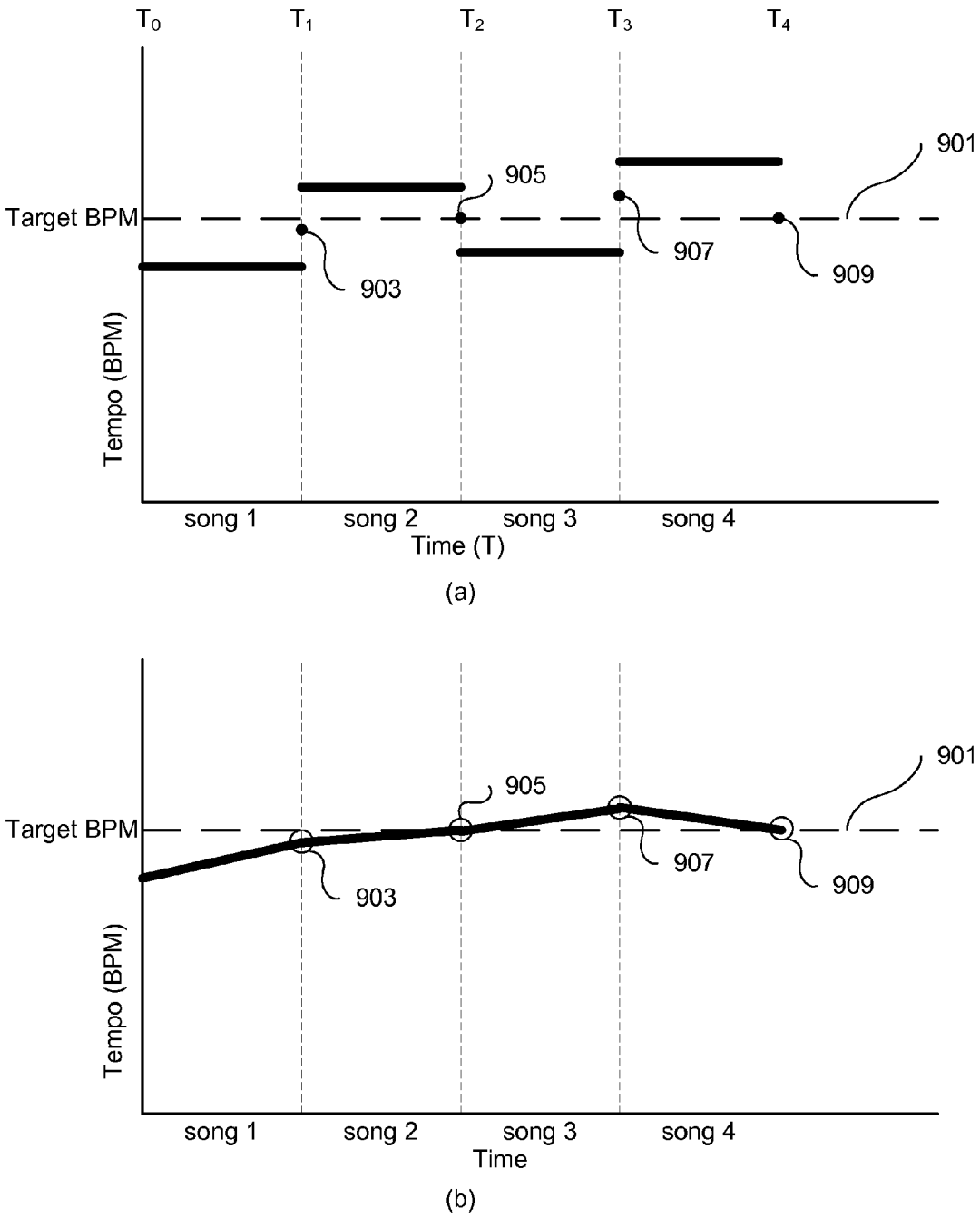
FIG. 9A is a diagram of an exemplary beat synchronization process according to one embodiment of the invention.

FIG. 9A is a diagram of an exemplary beat synchronization process according to one embodiment of the invention. Two graphs are shown, (a) and (b), each charting tempo vs. time for a series of four songs before and after beatmatching has occurred. A target BPM 901 is specified in both (a) and (b), for example as one of the event mix parameters acquired 201 in FIG. 2. The target BPM 901 is the desired tempo for an event mix segment and is represented by a horizontal dashed line. In this example, the event mix segment is created from the four songs shown.

In FIG. 9A (a), four songs of similar BPM are chosen. In this example, the songs have been chosen such that the BPM of any two subsequent songs falls on opposite sides of the target BPM 901. The arrangement shown is not central to the invention, however, and other arrangements are possible.

At time $T_0$, song 1 begins at the BPM shown, at time $T_1$, song 1 ends and song 2 begins. In order to beatmatch song 1 and song 2, a median BPM 903 is calculated for the transition point at $T_1$. In this example, the median BPM is calculated by averaging the tempo of song 1 at $T_1$ and the tempo of song 2 at $T_1$. Similarly, median BPMs 905 and 907 are calculated at $T_2$ and $T_3$, at the transition points between song 2 and song 3, and the transition point between song 3 and song 4, respectively. At $T_4$, an ending BPM 909 is shown, rather than a median BPM. In this example, the ending BPM 909 shown corresponds to the target BPM 901.

FIG. 9A (b) illustrates the same songs after beatmatching has been performed. At $T_0$, song 1 begins at the same starting tempo as shown for song 1 at $T_0$ in FIG. 9A (a). As song 1 progresses, the tempo is gradually increased in a linear fashion such that, at time $T_1$, the tempo of song 1 is the median BPM 903. At time $T_1$, song 2 begins at median BPM 903. Between time $T_1$ and $T_2$, the tempo of song two is gradually increased in a linear fashion such that, at time $T_2$, the tempo of song 2 is the median BPM 905. Similarly, the tempo of song 3 is adjusted between time $T_2$ and time $T_3$. Between time $T_3$ and $T_4$, the tempo of song 4 is gradually adjusted, in this case by decreasing the tempo linearly such that, at time $T_4$, the tempo of song 4 is the ending tempo 909. FIG. 9A does not illustrate beatmixing between subsequent songs, nor does it illustrate the media asset overlap interval over which one media asset is mixed into a subsequent media asset. However, in practice there will be a period over which each song is beatmixed into the next song over a specified media asset interval. In one embodiment of the invention, beatmixing between songs can be accomplished by using the beat-synchronization process 700 discussed in FIG. 7.

Figure 9B:
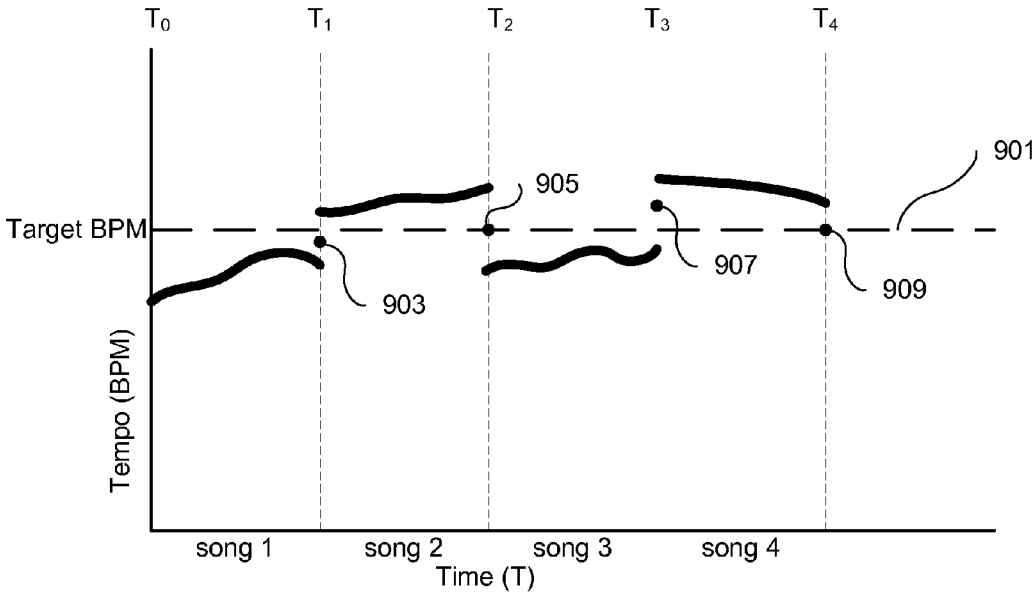
FIG. 9B is a diagram of an exemplary beat synchronization process according to one embodiment of the invention.
Figure 9B:
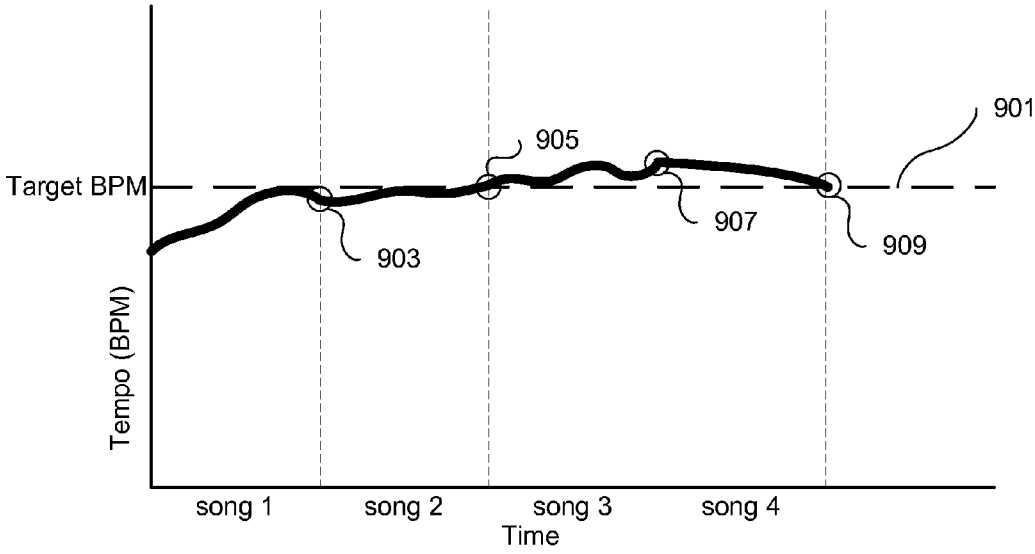

Note that, in FIG. 9A, each song is shown as having a constant tempo. However, it is rarely the case that there is no variation in tempo in a song. It is far more likely that, for any given song, tempo will vary somewhat throughout. To illustrate the creation of an event mix segment with songs that have variable tempo, FIG. 9B is shown. All figure numbers and descriptions for FIG. 9B are the same as for FIG. 9A. The only substantive difference between the FIG. 9A and FIG. 9B is the depiction of each song as having variable tempo. As in FIG. 9A, the tempo of the songs in FIG. 9B is adjusted linearly throughout each song. However, since the tempo of each song is variable, and the tempo adjustment is linear, the tempo variations of each song remain constant.

Figure 10:
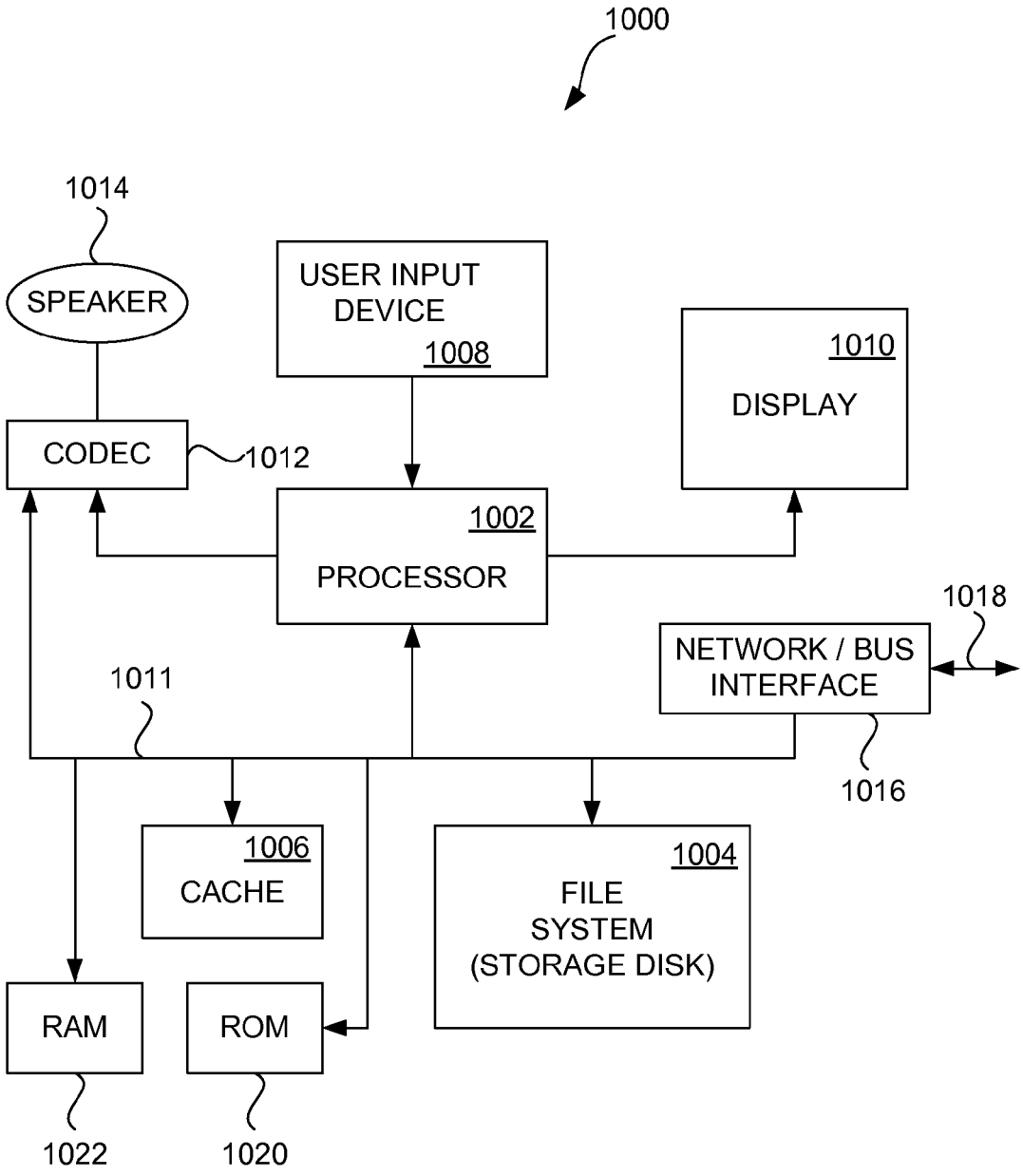
FIG. 10 is a block diagram of a media management system, according to one embodiment of the invention.

FIG. 10 is a block diagram of a media player 1000, in accordance with one embodiment of the present invention. The media player 1000 includes a processor 1002 that pertains to a microprocessor or controller for controlling the overall operation of the media player 1000. The media player 1000 stores media data pertaining to media assets (i.e., media files) in a file system 1004 and a cache 1006. The file system 1004 is, typically, a storage disk or a plurality of disks. The file system 1004 typically provides high capacity storage capability for the media player 1000. However, since the access time to the file system 1004 is relatively slow, the media player 1000 can also include a cache 1006. The cache 1006 is, for example, Random-Access Memory (RAM) provided by semiconductor memory. The relative access time to the cache 1006 is substantially shorter than for the file system 1004. However, the cache 1006 does not have the large storage capacity of the file system 1004. Further, the file system 1004, when active, consumes more power than does the cache 1006. The power consumption is often a concern when the media player 1000 is a portable media player that is powered by a battery (not shown). The media player 1000 also includes a RAM 1020 and a Read-Only Memory (ROM) 1022. The ROM 1022 can store programs, utilities or processes to be executed in a non-volatile manner. The RAM 1020 provides volatile data storage, such as for the cache 1006.

The media player 1000 also includes a user input device 1008 that allows a user of the media player 1000 to interact with the media player 1000. For example, the user input device 1008 can take a variety of forms, such as a button, keypad, dial, etc. Still further, the media player 1000 includes a display 1010 (screen display) that can be controlled by the processor 1002 to display information to the user. A data bus 1011 can facilitate data transfer between at least the file system 1004, the cache 1006, the processor 1002, and the CODEC 1012.

In one embodiment, the media player 1000 serves to store a plurality of media assets (e.g., songs) in the file system 1004. When a user desires to have the media player play a particular media asset, a list of available media assets is displayed on the display 1010. Then, using the user input device 1008, a user can select one of the available media assets. The processor 1002, upon receiving a selection of a particular media asset, supplies the media data (e.g., audio file) for the particular media asset to a coder/decoder (CODEC) 1012. The CODEC 1012 then produces analog output signals for a speaker 1014. The speaker 1014 can be a speaker internal to the media player 1000 or external to the media player 1000. For example, headphones or earphones that connect to the media player 1000 would be considered an external speaker.

The media player 1000 also includes a network/bus interface 1016 that couples to a data link 1018. The data link 1018 allows the media player 1000 to couple to a host computer. The data link 1018 can be provided over a wired connection or a wireless connection. In the case of a wireless connection, the network/bus interface 1016 can include a wireless transceiver.

In another embodiment, a media player can be used with a docking station. The docking station can provide wireless communication capability (e.g., wireless transceiver) for the media player, such that the media player can communicate with a host device using the wireless communication capability when docked at the docking station. The docking station may or may not be itself portable.

The wireless network, connection or channel can be radio frequency based, so as to not require line-of-sight arrangement between sending and receiving devices. Hence, synchronization can be achieved while a media player remains in a bag, vehicle or other container.

Figure 11:
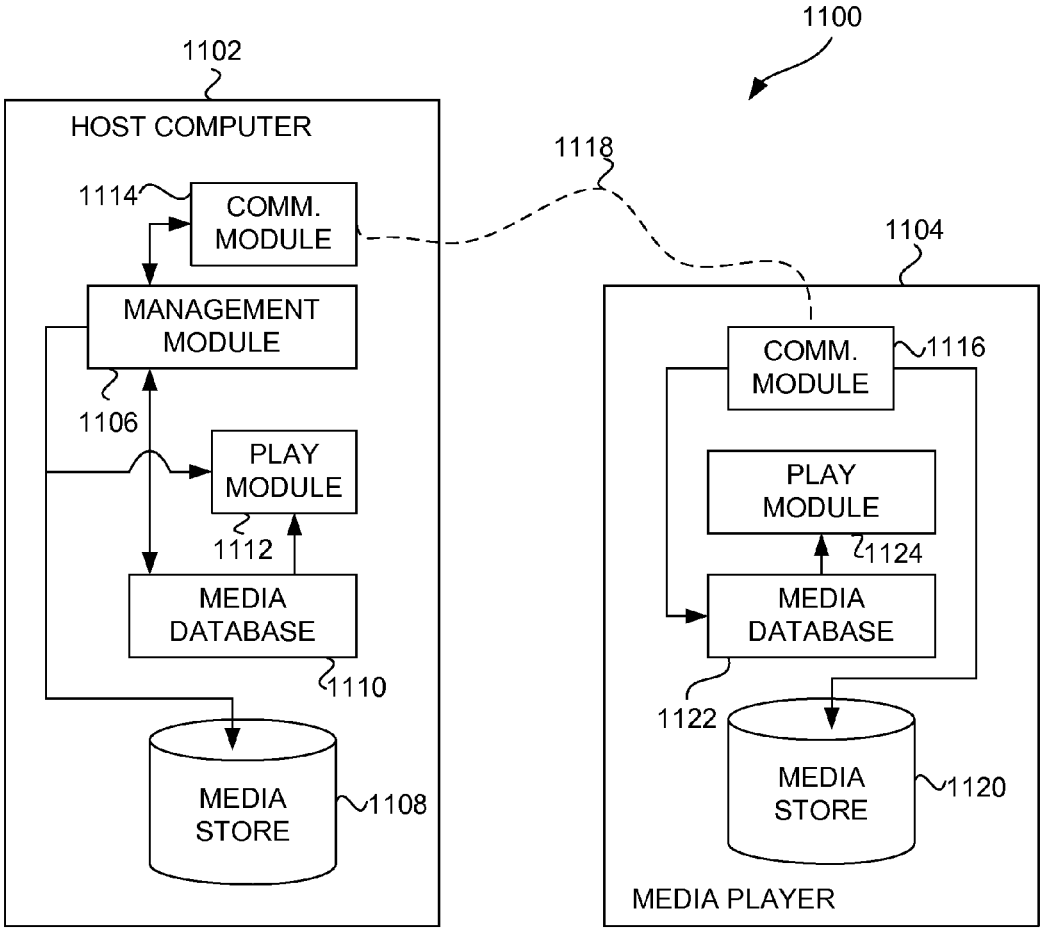
FIG. 11 is a block diagram of a media player according to one embodiment of the invention.

FIG. 11 is a block diagram of a media management system 1100, in accordance with one embodiment of the present invention. The media management system 1100 includes a host computer 1102 and a media player 1104. The host computer 1102 is typically a personal computer. The host computer, among other conventional components, includes a management module 1106, which is a software module. The management module 1106 provides for centralized management of media assets (and/or playlists) not only on the host computer 1102 but also on the media player 1104. More particularly, the management module 1106 manages those media assets stored in a media store 1108 associated with the host computer 1102. The management module 1106 also interacts with a media database 1110 to store media information associated with the media assets stored in the media store 1108.

The media information pertains to characteristics or attributes of the media assets. For example, in the case of audio or audiovisual media, the media information can include one or more of: tempo, title, album, track, artist, composer and genre. These types of media information are specific to particular media assets. In addition, the media information can pertain to quality characteristics of the media assets. Examples of quality characteristics of media assets can include one or more of: bit rate, sample rate, equalizer setting, and volume adjustment, start/stop and total time.

Still further, the host computer 1102 includes a play module 1112. The play module 1112 is a software module that can be utilized to play certain media assets stored in the media store 1108. The play module 1112 can also display (on a display screen) or otherwise utilize media information from the media database 1110. Typically, the media information of interest corresponds to the media assets to be played by the play module 1112.

The host computer 1102 also includes a communication module 1114 that couples to a corresponding communication module 1116 within the media player 1104. A connection or link 1118 removeably couples the communication modules 1114 and 1116. In one embodiment, the connection or link 1118 is a cable that provides a data bus, such as a FIREWIRE™ bus or USB bus, which is well known in the art. In another embodiment, the connection or link 1118 is a wireless channel or connection through a wireless network.

Hence, depending on implementation, the communication modules 1114 and 1116 may communicate in a wired or wireless manner.

The media player 1104 also includes a media store 1120 that stores media assets within the media player 1104. The media assets being stored to the media store 1120 are typically received over the connection or link 1118 from the host computer 1102. More particularly, the management module 1106 sends all or certain of those media assets residing on the media store 1108 over the connection or link 1118 to the media store 1120 within the media player 1104. Additionally, the corresponding media information for the media assets that is also delivered to the media player 1104 from the host computer 1102 can be stored in a media database 1122. In this regard, certain media information from the media database 1110 within the host computer 1102 can be sent to the media database 1122 within the media player 1104 over the connection or link 1118. Still further, playlists identifying certain of the media assets can also be sent by the management module 1106 over the connection or link 1118 to the media store 1120 or the media database 1122 within the media player 1104.

Furthermore, the media player 1104 includes a play module 1124 that couples to the media store 1120 and the media database 1122. The play module 1124 is a software module that can be utilized to play certain media assets stored in the media store 1120. The play module 1124 can also display (on a display screen) or otherwise utilize media information from the media database 1122. Typically, the media information of interest corresponds to the media assets to be played by the play module 1124.

Hence, in one embodiment, the media player 1104 has limited or no capability to manage media assets on the media player 1104. However, the management module 1106 within the host computer 1102 can indirectly manage the media assets residing on the media player 1104. For example, to "add" a media asset to the media player 1104, the management module 1106 serves to identify the media asset to be added to the media player 1104 from the media store 1108 and then causes the identified media asset to be delivered to the media player 1104. As another example, to "delete" a media asset from the media player 1104, the management module 1106 serves to identify the media asset to be deleted from the media store 1108 and then causes the identified media asset to be deleted from the media player 1104. As still another example, if changes (i.e., alterations) to characteristics of a media asset were made at the host computer 1102 using the management module 1106, then such characteristics can also be carried over to the corresponding media asset on the media player 1104. In one implementation, the additions, deletions and/or changes occur in a batch-like process during synchronization of the media assets on the media player 1104 with the media assets on the host computer 1102.

In another embodiment, the media player 1104 has limited or no capability to manage playlists on the media player 1104. However, the management module 1106 within the host computer 1102 through management of the playlists residing on the host computer can indirectly manage the playlists residing on the media player 1104. In this regard, additions, deletions or changes to playlists can be performed on the host computer 1102 and then by carried over to the media player 1104 when delivered thereto.

Additional information on music synchronization is provided in U.S. patent application Ser. No. 10/997,479, filed Nov. 24, 2004, and entitled "MUSIC SYNCHRONIZATION ARRANGEMENT," which is hereby incorporated herein by reference.

The advantages of the invention are numerous. Different embodiments or implementations may, but need not, yield one or more of the following advantages. One advantage of this invention is that users may create beat-synchronized event mixes without specific knowledge of advanced beat-matching and beat-mixing techniques. Another advantage of the invention is that users may acquire pre-selected descriptions of event mixes that have been professionally selected by DJs, personal trainers, or other music aficionados.

While this invention has been described in terms of several preferred embodiments, there are alterations, permutations, and equivalents, which fall within the scope of this invention. For example, although the media items of emphasis in several of the above embodiments were audio media assets (e.g., audio files or songs), the media items are not limited to audio media assets. For example, the media item can alternatively pertain to video media assets (e.g., movies). Furthermore, the various aspects, embodiments, implementations or features of the invention can be used separately or in any combination.

It should also be noted that there are many alternative ways of implementing the methods and apparatuses of the present invention. For example, the invention is preferably implemented by software, but can also be implemented in hardware or a combination of hardware and software. The invention can also be embodied as computer readable code on a computer readable medium. The computer readable medium is any data storage device that can store data, which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

It is therefore intended that the following appended claims be interpreted as including all such alterations, permutations, and equivalents as fall within the true spirit and scope of the present invention.

What is claimed is:

1. In a digital media player, a computer-implemented method for creating a beat-synchronized event mix, comprising:

(a) selecting a plurality of media assets;

(b) arranging the media assets into an unsynchronized media mix;

(c) determining a beat profile of each of the media assets in the media mix, the beat profile being across the media mix and provides a record of beat locations in each of the media assets in the media mix;

(d) automatically beatmatching the beats of adjacent media assets in the media mix; and (e) automatically beatmixing the beats of adjacent beat-matched media assets to create the beat-synchronized media mix, wherein the beat-synchronized media mix is created as arranged in the unsynchronized media mix.

2. The computer-implemented method of claim 1, wherein the plurality of media assets are selected from the group consisting MPEG-1 Layer 2, MPEG-1 Layer 3 (MP3), MPEG-AAC, WMA, Dolby AC-3, and Ogg Vorbis.

3. The computer-implemented method of claim 1, wherein the plurality of media assets are music videos.

4. The computer-implemented method of claim 1, wherein the selecting (a) further comprises:

(a)(1) examining the media assets in a media library; and (a)(2) selecting from among the examined media assets, files that meet a specified media asset selection criteria.

5. The computer-implemented method of claim 3, wherein the specified criteria are selected from the group consisting of music tempo, music genre, music intensity, media asset duration, user rating, and music mood.

6. The computer-implemented method of claim 4, wherein the media library is stored locally.

7. The computer-implemented method of claim 4, wherein the media library is an online media store.

8. The computer-implemented method of claim 7, wherein the online media store suggests additional media assets for use in the beat-synchronized media mix.

9. The computer-implemented method of claim 8, wherein the additional media assets are selected based on online media store user ratings.

10. The computer-implemented method of claim 4, wherein the media library is an online media database.

11. The computer-implemented method of claim 1, further comprising concatenating two or more beat-synchronized media mixes.

12. The computer-implemented method of claim 11, wherein each beat-synchronized media mix corresponds to a beat-synchronized event mix segment.

13. The computer-implemented method of claim 12, wherein an event mix comprises one or more beat-synchronized event mix media segments.

14. The computer-implemented method of claim 13, wherein each beat-synchronized media segment has a different intensity.

15. The computer-implemented method of claim 13, wherein intensity is determined by media speed in beats per minute (BPM).

16. The computer-implemented method of claim 13, wherein intensity is determined by a user-assigned intensity rating.

17. The computer-implemented method of claim 1, wherein the beat profile of a media asset contains BPM information for the media asset measured at regular intervals.

18. The computer-implemented method of claim 1, wherein the beatmixing (e) occurs over a media asset overlap interval.

19. The computer-implemented method of claim 1, wherein the beat-synchronized media mix is an event mix, and wherein the event mix is subdivided into one or more event mix segments.

20. A computer-implemented method for beat-synchronizing a pair of media assets, comprising:

determining a beat profile of each media asset in the pair of media assets to identify beat locations in each media asset in the pair of media assets, the beat profile including: the beat profile of at least an end segment of a first media asset in the pair of media assets and the beat profile of at least a beginning segment of a second media asset in the pair of media assets;

automatically adjusting the speed of the end segment of the first media asset in the pair of media assets to match the speed of the beginning segment of the second media asset in the pair of media assets;

determining the beat offset of the beginning segment of the second media asset in the pair of media assets;

automatically offsetting the beginning segment of the second media asset by the beat offset; and automatically mixing the pair of media assets together.

21. A computer-implemented system for creating beat synchronized media mixes, comprising:

a beat-synchronized media mix creator;

a media database connected to the media mix creator;

media content storage connected to the media mix creator; and media content storage connected to the media database, wherein the beat-synchronized media mix creator is configured to determine a beat profile across a media mix having at least two media assets and identify beat locations in two or more of the at least two media assets in the media mix.

22. The computer-implemented system of claim 21, wherein the media database is connected to an online media store.

23. The computer-implemented system of claim 22, wherein the online media store makes media suggestions for the media mix creator.

24. The computer-implemented system of claim 23, wherein the media suggestions are available for purchase at the online media store.

25. The computer-implemented system of claim 23, wherein the beat-synchronized media mix creator creates event mixes.

26. The computer-implemented system of claim 25, wherein the event mix is selected from the group comprising a workout mix and a dance mix.

27. A computer readable media having at least executable computer program code tangibly embodied therein, comprising:

(a) computer code for selecting a plurality of media assets;

(b) computer code for arranging the media assets into an unsynchronized media mix;

(c) computer code for determining a beat profile of each of the media assets in the media mix, the beat profile being across the media mix and provides a record of beat locations in each of the media assets in the media mix;

(d) computer code for automatically beatmatching the beats of adjacent media assets in the media mix; and (e) computer code for automatically beatmixing the beats of adjacent beatmatched media assets to create the beat-synchronized media mix, wherein the beat-synchronized media mix is created as arranged in the unsynchronized media mix.

28. A computer readable media having at least executable computer program code tangibly embodied therein, comprising:

computer code for determining a beat profile of each media asset in the pair of media assets to identify beat locations in each media asset in the pair of media assets, the beat profile including: the beat profile of at least an end segment of a first media asset in the pair of media assets and the beat profile of at least a beginning segment of a second media asset in the pair of media assets;

computer code for automatically adjusting the speed of the end segment of the first media asset in the pair of media assets to match the speed of the beginning segment of the second media asset in the pair of media assets;

computer code for determining the beginning segment of the second media asset in the pair of media assets;

computer code for automatically offsetting the beginning segment of the second media asset by the beat offset; and computer code for automatically mixing the pair of media assets together.

* * * * *